US006595087B2

(12) United States Patent
Whalen et al.

(10) Patent No.: US 6,595,087 B2
(45) Date of Patent: Jul. 22, 2003

(54) ENCAPSULATED DEAD BLOW HAMMER WITH IMPROVED SKELETON

(75) Inventors: Thomas J. Whalen, Kenosha, WI (US); Richard Wroblewski, Kenosha, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/991,104

(22) Filed: Nov. 21, 2001

(65) Prior Publication Data

US 2003/0094080 A1 May 22, 2003

(51) Int. Cl.[7] ..... B25D 1/12
(52) U.S. Cl. ..... 81/22; 81/26
(58) Field of Search ..... 81/22, 25, 26

(56) References Cited

U.S. PATENT DOCUMENTS

| | | | | |
|---|---|---|---|---|
| 2,989,101 A | | 6/1961 | Carmien | 81/19 |
| 3,000,414 A | | 9/1961 | Cordis | 81/22 |
| 3,130,762 A | | 4/1964 | Kerr | 81/25 |
| 3,444,908 A | | 5/1969 | Roth | 81/19 |
| 3,605,832 A | | 9/1971 | Stephens | 81/25 |
| 3,844,321 A | | 10/1974 | Cook | 81/26 |
| 4,039,012 A | | 8/1977 | Cook | 81/22 |
| 4,697,481 A | | 10/1987 | Maeda | 81/22 |
| 4,831,901 A | | 5/1989 | Kinne | 81/25 |
| 4,934,024 A | | 6/1990 | Sexton, I | 16/421 |
| 5,056,381 A | * | 10/1991 | Carmein | 76/103 |
| 5,141,353 A | | 8/1992 | Meredith et al. | 403/267 |
| 5,262,113 A | | 11/1993 | Carmien | 264/257 |
| D350,269 S | | 9/1994 | Majors et al. | D8/77 |
| D350,470 S | | 9/1994 | Majors et al. | D8/80 |
| 5,375,486 A | | 12/1994 | Carmien | 81/21 |
| D356,481 S | | 3/1995 | Majors et al. | D8/80 |
| 5,408,902 A | | 4/1995 | Burnett | 81/22 |
| 5,458,840 A | * | 10/1995 | Carmien | 264/221 |
| 5,537,896 A | | 7/1996 | Halder | 81/26 |
| 5,657,674 A | | 8/1997 | Burnett | 81/22 |
| 5,911,795 A | * | 6/1999 | Tucker | 81/22 |
| 5,916,338 A | * | 6/1999 | Bergkvist et al. | 81/22 |
| 5,960,677 A | * | 10/1999 | Carmien | 81/22 |
| 6,009,600 A | * | 1/2000 | Egeland et al. | 16/436 |
| 6,052,885 A | | 4/2000 | Carmien | 81/22 |
| 6,106,755 A | | 8/2000 | Pfoertner | 264/135 |
| 6,234,048 B1 | | 5/2001 | Carmien | 81/22 |
| 6,370,986 B1 | * | 4/2002 | Scott | 81/22 |

FOREIGN PATENT DOCUMENTS

| | | |
|---|---|---|
| GB | 667320 | 2/1952 |

OTHER PUBLICATIONS

Photograph of Nupla hammer.
Photograph of Task Force hammer.
Photograph of Stanley hammer.

* cited by examiner

*Primary Examiner*—Joseph J. Hail, III
*Assistant Examiner*—David B. Thomas
(74) *Attorney, Agent, or Firm*—Seyfarth Shaw

(57) ABSTRACT

A dead blow hammer has a skeleton including a cylindrical head tube and a cylindrical neck tube fixed to the head tube and projecting laterally therefrom and receiving therein a disk-like plastic spacer and the working end of an elongated plastic handle core, which is adhesively secured in the neck tube. The head tube contains shot and the ends thereof are closed by end caps having cylindrical, longitudinally-slotted flanges press-fitted in the ends of the head tube. The entire skeleton is encapsulated in an overmolded plastic sheath which includes an inner covering and a flexible and resilient grip further overmolded on the inner covering adjacent to the distal end of the handle member.

26 Claims, 2 Drawing Sheets

ENCAPSULATED DEAD BLOW HAMMER WITH IMPROVED SKELETON

BACKGROUND

This application relates to impact tools, such as hammers and, in particular, relates to hammers of the type designed to minimize rebound, commonly referred to as "dead blow" hammers.

Dead blow hammers are typically provided with a head which is at least partially hollow and contains a rebound-inhibiting material, which may be a flowable material and can be in the form of rigid pellets, such as steel shot, for example. However, many such hammers have handles which extend through the head, thereby inhibiting the flow of material back and forth between impact ends of the head.

It is known to provide dead blow hammers formed from a skeleton head and handle framework, partially or fully encapsulated or encased within an outer covering which may be overmolded on the skeleton. However, such prior encapsulated hammers have had complicated or expensive skeleton constructions and/or have been characterized by less than optimal weight distribution between the handle and the head.

SUMMARY

There is disclosed in this application a hammer construction and method of forming same which avoid the disadvantages of prior constructions and methods while affording additional structural and operating advantages.

An important aspect is the provision of a hammer which is of simple and economical construction.

Another aspect is the provision of a dead blow hammer with improved non-rebound characteristics and weight distribution.

Still another aspect is the provision of a hammer of the type set forth, which minimizes wear between adjacent parts.

Still another aspect is the provision of a hammer of the type set forth, which is characterized by a comfortable ergonomic design.

Certain ones of these and other aspects may be attained by providing a hammer comprising: an elongated head having a longitudinal axis, a neck tube integral with the head and projecting therefrom and inclined with respect to the longitudinal axis, a handle including a member having a proximal working end received in the neck tube and a distal end, and a spacer disposed in the neck tube between the head and the handle member working end.

Other aspects may be attained by providing such a hammer wherein the head is a hollow tube with an open end, closed by an end cap having a cylindrical flange press-fitted in the open end of the head tube.

Other aspects may be attained by providing a method of making a hammer comprising:

providing a hollow tubular head and a neck tube integral with the head tube and extending therefrom, inserting a working end of a handle core member in the neck tube so that it is spaced from the head, and encapsulating the head and the neck tube and the core member in a plastic sheath.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
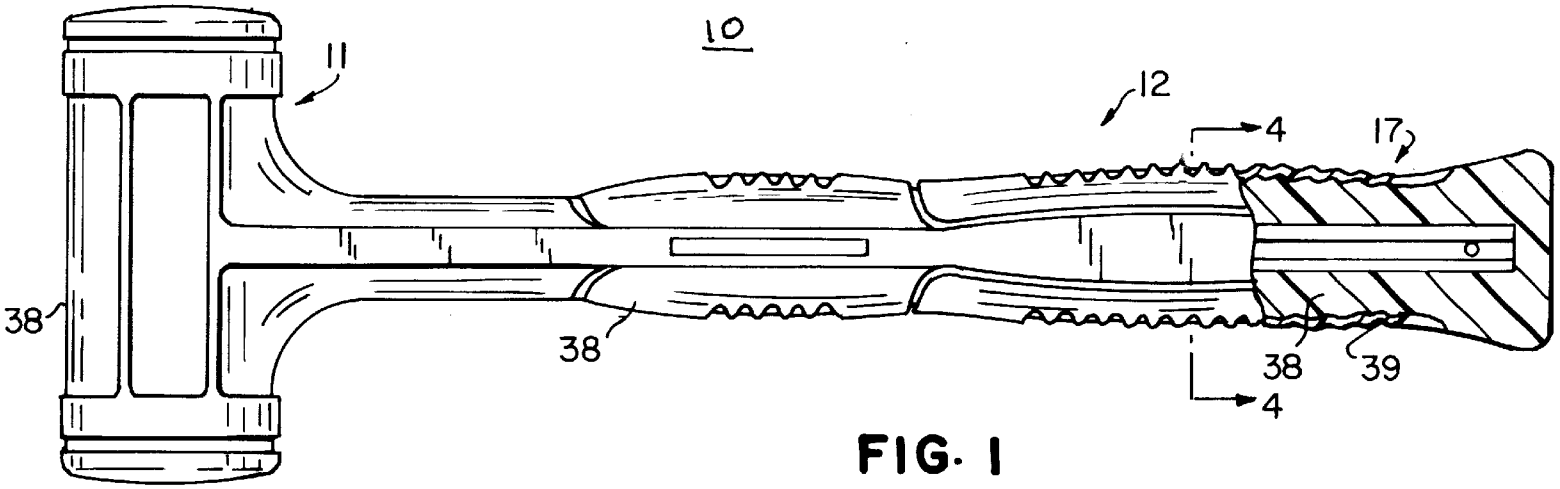
FIG. 1 is a side elevational view, in partial section, of a dead blow hammer.

Referring to FIGS. 1–4, there is illustrated a dead blow hammer generally designated by the numeral 10, which includes a head 11 and a handle 12. The hammer 10 is made up of an internal skeleton framework 15 (FIG. 2) surrounded with an encapsulating sheath 17.

Figure 2:
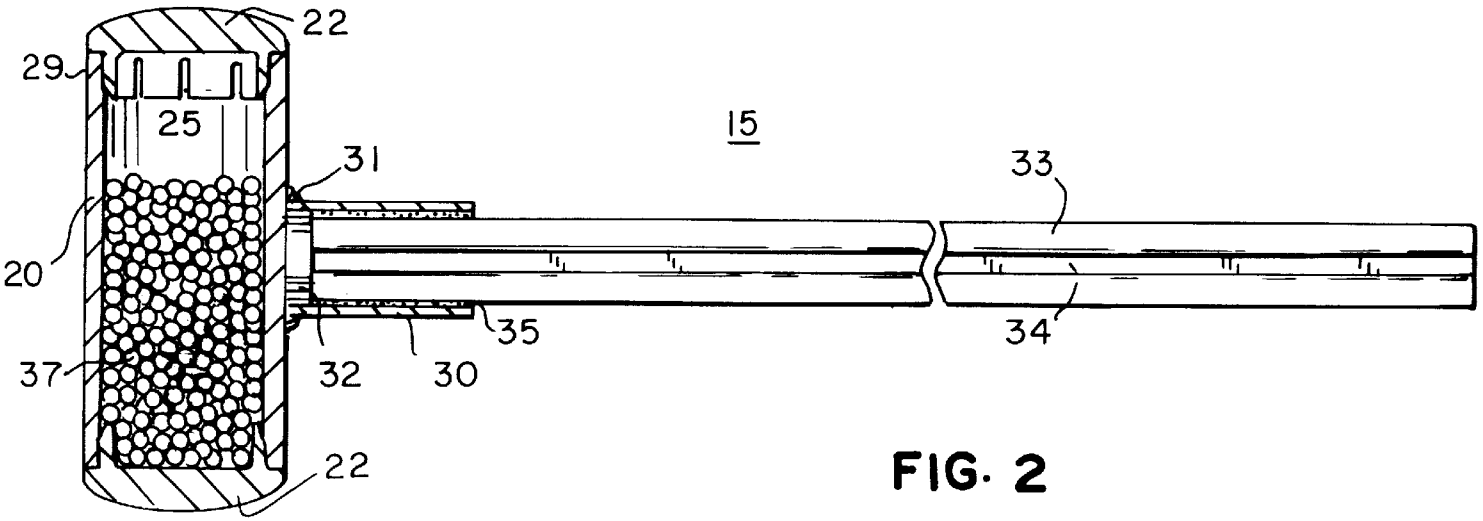
FIG. 2 is a view in partial section of the skeleton of the hammer of FIG. 1.
Figure 6:
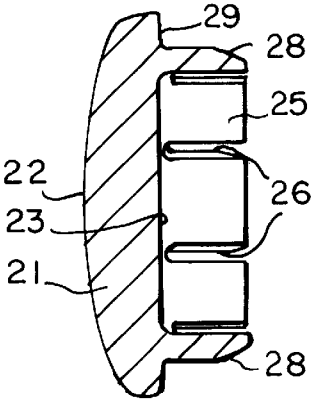
FIG. 6 is a sectional view taken generally along the line 6—6 in FIG. 5.
Figure 5:
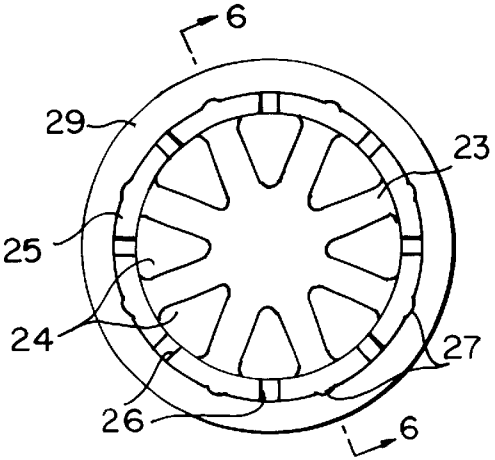
FIG. 5 is an enlarged, bottom plan view of an end cap of the skeleton of FIG. 2.

Referring to FIG. 2, the skeleton framework 15 includes an elongated, circularly cylindrical head tube 20 having a central longitudinal axis and two open ends, respectively closed by end caps 21 which are of substantially identical construction. Referring also to FIGS. 5 and 6, each end cap 21 is circular in shape and has a slightly convex outer surface 22 and a substantially flat, planar inner surface 23 having a plurality of equiangularly spaced, generally wedge-shaped recesses 24 formed therein. Depending from the inner surface 23 is a cylindrical flange 25 having formed in its distal end a plurality of circumferentially spaced and axially extending slots 26, each terminating just short of the inner surface 23. Projecting radially outwardly from the outer surface of the flange 25 are a plurality of longitudinally extending beads or ribs 27 alternating with the slots 26 so that each bead 27 is disposed substantially midway between an adjacent pair of slots 26. The outer surface of the flange 25 is beveled adjacent to its distal end, as at 28. The flange 25 is coaxial with the cap 21 and has an outer diameter less than that of the cap 21, so that the intervening portion of the inner surface 23 defines an annular shoulder 29.

In assembly, each end cap flange 25 is dimensioned to be press fitted in an open end of the head tube 20, the slots 26 cooperating to define a plurality of spaced fingers which have a slight flexibility to facilitate insertion in the head tube 20, this insertion further being facilitated by the beveling at 28. The beads 27 ensure a snug fit. The cap 21 is so dimensioned that, when fully inserted in place, the annular shoulder 29 will abut the adjacent end of the head tube 20 (see FIG. 2), the outer diameter of the cap 21 being substantially the same as that of the head tube 20.

Fixedly secured to the outer surface of the head tube 20, approximately centrally along its length, and projecting radially outwardly therefrom is a cylindrical neck tube 30, which may be fixedly secured to the head tube 20 by a suitable weldment 31. Seated in the neck tube 30 against the outer surface of the head tube 20 is a circular, disk-shaped spacer 32. The handle portion of the skeleton framework 15 includes a member in the form of an elongated handle core 33 which, in transverse cross section, is substantially in the shape of a square with angled or beveled corners (see FIG. 4). Formed in opposite sides of the core 33 and extending longitudinally thereof along the entire length thereof are channel-shaped grooves 34. The core 33 is dimensioned to be freely received in the neck tube 30 and seated against the spacer 32, being fixedly secured in place by suitable means, such as by a suitable adhesive 35 which fills the voids in the neck tube 30 (see FIG. 2).

In assembly, before or after the handle core 33 is fixed in the neck tube 30 against the spacer 32, as described above, one end cap 21 is fitted in place to close one end of the head tube 20. Then the head tube 20 is partially filled with a flowable, rebound-inhibiting material, which may be in the form of rigid pellets, such as steel shot 37. Then the other end cap 21 is secured in place to completely close the head tube 20 and complete the skeleton framework 15 of the hammer 10.

Figure 4:
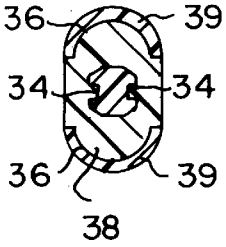
FIG. 4 is a view in vertical section taken generally along the line 4—4 in FIG. 1.
Figure 3:
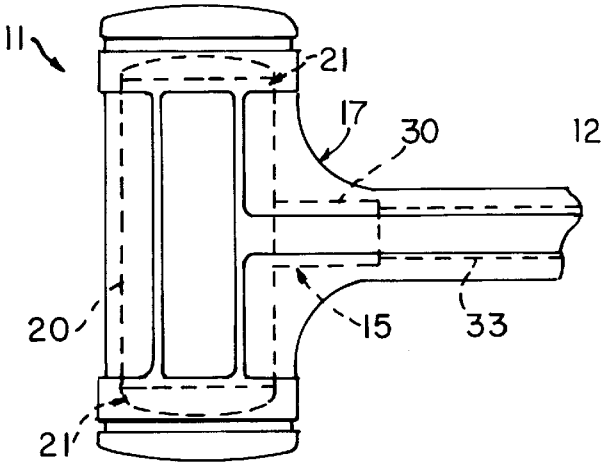
FIG. 3 is a reduced, fragmentary view of the left-hand end of the hammer of FIG. 1, illustrating the skeleton in broken line.

Then, the encapsulating sheath 17 is applied by overmolding the skeleton framework 15 with suitable moldable materials, such as suitable plastics, completely encapsulating the entire skeleton framework 15, as best seen in FIG. 1. The finished handle cross section may have a generally oblong or oval shape, as illustrated in FIG. 4. The encapsulating sheath 17 includes an inner covering 38 of a first material, which completely covers the skeleton framework 15 and defines, in a grip portion adjacent to the distal end of the handle 12, recesses 36 along the upper and lower sides of the handle 12. The recesses 36 are filled, in a further overmolding process, with an outer layer of material forming outer grips 39.

In a constructional model of the hammer, the head tube 20, the end caps 21 and the neck tube 30 may be formed of suitable metals, such as suitable steels for the head tube and the neck tube and suitable zinc alloys for the end caps. The handle core 33 may be formed of a relatively lightweight, strong, non-metallic material, such as fiberglass. The spacer 32 and the inner covering 38 and the outer grips 39 may be formed of suitable moldable plastic materials, such as suitable urethanes. The outer layer forming the outer grips 39 may be of a softer, flexible and resilient material than the inner covering 38 to form a more comfortable grip. The inner covering 38 and outer grips 39 may be applied by injection molding.

The head tube 20 is designed with an appropriate wall thickness and diameter to produce the desired overall hammer weight. The zinc alloy of the end caps 21 is designed to be resistant to impact forces. The convex outer surface 22 of the end cap 21 is designed to be resistant to the injection molding pressures to which the head is subjected in applying the encapsulating sheath 17.

As was explained above, the end cap slots 26 stop short of the inner surface 23, so as to provide additional sealing within the head tube 20. The flexibility of the end cap flange 25 afforded by the slots 26 facilitates press fitting, permitting proper assembly irrespective of tolerance variations in the inner diameter of the head tube 20. The grooves 34 along the handle core 33 facilitate adequate positioning of the skeleton framework 15 in the injection molding dies, as well as serving to prevent the encapsulating sheath 17 from twisting or slipping around the handle core 33 during strenuous use. The spacer 32 serves to provide vibration absorption, to eliminate impact vibration or shock which would otherwise be transmitted down the handle core 33 upon hammer strike and then into the user's hand. The spacer 32 also serves to minimize unwanted wear which might be occasioned by direct engagement of the fiberglass handle core 33 with the steel head tube 20.

The composite handle 12, formed of relatively lightweight materials, together with the metal head tube 20, facilitates an improved weight distribution in the hammer 10 without reducing the overall weight of the hammer. More specifically, weight has been transferred from the handle to the head and, as a result, the hammer's center of percussion is moved further forward, permitting the hammer 10 to deliver approximately 30% more force during use than prior designs. By attaching the fiberglass handle core 33 to the steel head tube 20 by means of an externally welded neck tube 30, there is no extension of the handle core 33 through the head tube 20, resulting in an unobstructed flow of steel shot within the head tube. The use of a skeleton framework 15 which is partially fiberglass and partially steel provides an improved result over prior all-fiberglass skeletons, by permitting the hammer 10 to be approximately 30% smaller than hammers with all-fiberglass skeletons of the same weight. As a result, the hammer 10 can be used in tighter, more restrictive areas.

From the foregoing, it can be seen that there has been provided an improved dead blow hammer which is of simple and economical construction, improved weight distribution and force-delivering capacity, and improved vibration resistance and ergonomic design.

The matter set forth in the foregoing description and accompanying drawings is offered by way of illustration only and not as a limitation. While a particular embodiment has been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A hammer comprising:

an elongated head having a longitudinal axis, a neck tube integral with the head and projecting therefrom and inclined with respect to the longitudinal axis, a handle including a member having a proximal working end received in the neck tube and a distal end, and a spacer disposed in the neck tube between the head and the handle member working end.

2. The hammer of claim 1, wherein the spacer is formed of a plastic material.

3. The hammer of claim 1, wherein the handle member is a core member formed of fiberglass and secured to the neck tube.

4. The hammer of claim 3, and further comprising a plastic sheath encapsulating the head and the neck tube and the core member.

5. The hammer of claim 4, wherein the plastic sheath includes a flexible resilient grip disposed adjacent to the distal end of the handle member.

6. The hammer of claim 4, wherein the core member has longitudinally extending grooves formed therein respectively along opposite sides thereof, the material of the plastic sheath being received in the grooves to inhibit rotation of the sheath relative to the core member.

7. The hammer of claim 1, wherein the handle member is adhesively secured in the neck tube.

8. A hammer comprising an elongated cylindrical head tube having a longitudinal axis and an open end, a handle fixed to the head tube and projecting therefrom and inclined with respect to the longitudinal axis, and an end cap having a generally cylindrical flange press fitted inside the open end of the head tube for closure thereof, the flange includes a plurality of circumferentially spaced, axially extending beads projecting radially outwardly from an outer surface thereof.

9. The hammer of claim 8, and further comprising a rebound-inhibiting filler material disposed in a head tube.

10. The hammer of claim 9, wherein the filler material includes rigid pellets.

11. The hammer of claim 8, wherein the head tube has two open ends, the end cap being a first end cap for closure of one of the open ends, and further comprising a second end cap having a generally cylindrical flange press fitted in the other open end of the head tube for closure thereof.

12. The hammer of claim 8, wherein the cylindrical flange has a plurality of circumferentially-spaced slots formed in a distal end thereof.

13. The hammer of claim 8, and further comprising a plastic sheath encapsulating the head tube and the handle.

14. A hammer comprising:

an elongated cylindrical head tube having a longitudinal axis and an open end, a neck tube integral with the head tube and projecting therefrom and inclined with respect to the longitudinal axis, a handle including a member having a proximal working end received in the neck tube and a distal end, a spacer disposed in the neck tube between the head tube and the handle member working end, and an end cap having a generally cylindrical flange press fitted in the open end of the head tube for closure thereof.

15. The hammer of claim 14, wherein the spacer is in the form of a circularly cylindrical body.

16. The hammer of claim 15, wherein the spacer is formed of a plastic material.

17. The hammer of claim 14, wherein the handle member is a core member formed of fiberglass and secured to the neck tube.

18. The hammer of claim 17, wherein the core member has longitudinally extending grooves formed therein respectively along opposite sides thereof.

19. The hammer of claim 18, and further comprising a plastic sheath encapsulating the head tube and the neck tube and the core member and filling the grooves.

20. The hammer of claim 14, wherein the head tube has two open ends, the end cap being a first end cap for closure of one of the open ends, and further comprising a second end cap having a generally cylindrical flange press fitted in the other open end of the head tube for closure thereof.

21. A method of making a hammer comprising:

providing a hollow tubular head and a neck tube integral with the head and extending therefrom, inserting a working end of a handle core member in the neck tube so that it is spaced from the head, and encapsulating the head and the neck tube and the core member in a plastic covering.

22. The method of claim 21, and further comprising inserting a spacer member in the neck tube before insertion of the working end of the core member to effect the spacing of the core member from the head.

23. The method of claim 21, and further comprising adhesively securing the core member in the neck tube.

24. The method of claim 21, and further comprising filling the tubular head with a rebound-inhibiting material.

25. The method of claim 21, and further comprising providing the tubular head with an open end, and closing the open end of the head by press fitting therein a generally cylindrical flange of an end cap.

26. The method of claim 21, and further comprising overmolding a grip on the plastic covering adjacent to a distal end of the core member.

* * * * *